US005784845A

United States Patent [19]

Imeokparia et al.

[11] Patent Number: 5,784,845

[45] Date of Patent: *Jul. 28, 1998

[54] OPEN-CELL FOAMS IN ROOFING SYSTEMS

[75] Inventors: Daniel D. Imeokparia, Pickerington; Creston D. Shimdt, Nashport; Kyung W. Suh, Granville; Michael J. Ennis, Reynoldsburg, all of Ohio

[73] Assignee: The Dow Chemical Company, Midland, Mich.

[ * ] Notice: The term of this patent shall not extend beyond the expiration date of Pat. No. 5,557,896.

[21] Appl. No.: 737,203

[22] PCT Filed: Apr. 6, 1995

[86] PCT No.: PCT/US95/04261

§ 371 Date: Oct. 31, 1996

§ 102(e) Date: Oct. 31, 1996

[87] PCT Pub. No.: WO96/00335

PCT Pub. Date: Jan. 4, 1996

[51] Int. Cl.[6] ..... E04C 2/20; E04D 1/22

[52] U.S. Cl. ..... 52/408; 52/309.6; 52/309.8; 52/409; 52/515; 52/746.11

[58] Field of Search ..... 52/408, 309.6, 52/309.8, 514, 515, 517, 746.11, 409, 516

[56] References Cited

U.S. PATENT DOCUMENTS

| | | |
|---|---|---|
| 2,861,525 | 11/1958 | Curtis et al. . |
| 3,345,246 | 10/1967 | Sheahan . |
| 3,411,256 | 11/1968 | Best . |
| 3,862,527 | 1/1975 | Peterson . |
| 4,235,058 | 11/1980 | Patry . |
| 4,532,265 | 7/1985 | Park et al. . |
| 5,067,298 | 11/1991 | Petersen . |
| 5,286,757 | 2/1994 | Smith et al. . |
| 5,373,026 | 12/1994 | Bartz et al. . |
| 5,411,687 | 5/1995 | Imeokparia et al. . |
| 5,557,896 | 9/1996 | Imeokparia et al. ..... 52/408 |

FOREIGN PATENT DOCUMENTS

| | | |
|---|---|---|
| 0084226 | 7/1983 | European Pat. Off. . |
| 0442102 | 8/1991 | European Pat. Off. . |
| 2552801 | 4/1985 | France . |

OTHER PUBLICATIONS

The Dow Chemical Company, Styrofoam Protected Membrane Roofing Technical Data, published Feb. 1993.

The Dow Chemical Company, Styrofoam Brand Roofing Recovery Board Product Data, published Mar., 1992.

The Dow Chemical Company, Dow High Performance Underlayment, Dow TechNote 514, published May, 1993.

*Primary Examiner*—Christopher Kent

*Attorney, Agent, or Firm*—J. Robert Dean, Jr.

[57] ABSTRACT

A roofing system (20) for a structure such as a building. The system (20) includes a roof deck (10), a plurality of panels (12) of an extruded alkenyl aromatic polymer foam above and adjacent the deck (10); and a substantially waterproof membrane (14), above and adjacent to the foam. The foam has an open cell content of 30 percent or more. The foam provides excellent mechanical support for the membrane (14), and is water resistant. The foam further has a high heat distortion temperature, and is substantially free of distortion at high service temperatures encountered in roofing systems. Further disclosed is a recovery roofing system employing the above foam. Further disclosed are processes for constructing a new roofing system and a recovery roofing system.

23 Claims, 2 Drawing Sheets

OPEN-CELL FOAMS IN ROOFING SYSTEMS

BACKGROUND OF THE INVENTION

This invention relates to a method of employing an extruded, open-cell alkenyl aromatic polymer foam in roofing systems.

Roofing systems typically comprise multiple layers of various materials configured to protect and optionally to insulate a roof deck or upper surface of a structure or building. The roofing system protects the deck and the interior of the structure from the weather, including wind, rain, and other precipitation.

The critical component of a roofing system is the membrane. The membrane is a sheet or mat of a solid, elastomeric substance which protects the deck from the aforementioned weather elements. Conventional membranes include those of EPDM (ethylene-propylene-diene elastomer), modified bitumen, and plasticized polyvinylchloride. The membrane may be dark, medium, or light in color, but is usually dark.

When installing a new roofing system, the membrane is placed or laid on top of the roof deck. A protective layer may be typically inserted between the membrane and the deck. The protective layer may take the form of an insulative plastic foam or, more commonly, a non-foam material such as a wood or wood composite panel. Commercially-employed plastic foams include polystyrene bead foam, closed-cell extruded polystyrene foam, and closed-cell polyisocyanurate and polyurethane foams.

Optionally, a paving layer may be placed or laid on top of the membrane. The paving layer typically comprises materials such as gravel or stone ballast, shingles, brick, or concrete. The paving layer functions to physically protect the membrane from foot traffic and direct exposure to sunlight and the weather.

When replacement or recovery roofing systems are installed in existing structures or buildings, they are often installed over existing roofing systems. In a typical recovery system, a protective layer is applied or laid on top of the existing roofing system, usually an old membrane or an old paving layer; a new membrane is applied or laid on top of the protective layer; and, optionally, a new paving layer is applied on top of the new membrane. The protective layer protects the new membrane from the rough and uneven surfaces often encountered on the upper surfaces of existing roofing systems, provides mechanical support underneath the new membrane, and, in the case of plastic foams, provides additional insulation.

A problem commonly encountered with roofing systems is rupture of the membrane due to distortion or deterioration of the protective layer underneath the membrane. The distortion and deterioration problems arise from the exposure of the protective layer to extreme heat from direct sunlight or moisture buildup due to weather exposure. The membrane, which is typically dark and elastomeric, absorbs significant heat from the sunlight, and further does not allow for timely escape of moisture trapped underneath it. When the insulating and/or protective layer becomes distorted or deteriorated, the membrane and the protective layer may separate to form void pockets, which leave the membrane with diminished mechanical support on its undersurface. The diminished support renders the membrane more subject to rupture.

The source of distortion and deterioration problems of the material in the protective layer varies according to the nature of the material. Some materials are susceptible to heat, some are susceptible to moisture, and some have inherently low mechanical strength.

Extruded, closed-cell polystyrene foams offer excellent mechanical strength and water resistance, but can become distorted at high service temperatures (greater than 165° F.) due to their relatively low heat distortion temperature. Such high service temperatures are typically encountered under a dark membrane in direct sunlight.

Expanded polystyrene bead foams typically better maintain their shape in a high temperature environment than extruded, closed-cell polystyrene foams because they typically have better bowing characteristics. Their bowing characteristics are better because the coalesced expanded bead structure allows for greater mechanical relaxation compared to the solid, cellular form of extruded, closed-cell foams. However, the coalesced expanded bead structure also results in lower mechanical strength and lower resistance to water transmission.

Closed-cell polyisocyanate foams have high heat distortion temperatures (250° F.–275° F.) (121° C.–135° C.), but have poor moisture resistance. Moisture weakens the cellular structure of such foams, and renders them subject to physical deterioration over time. Moisture also diminishes the insulation value of the foam. They are also relatively friable, which affects their handling characteristics.

Closed-cell polyurethane foams, like closed-cell polyisocyanate foams, have high heat distortion temperatures and poor moisture resistance. They are also relatively friable, which affects their handling characteristics.

Wood panels and wood composite panels have high heat distortion temperatures, but have poor moisture resistance. Moisture weakens the wood, and renders it subject to physical deterioration over time. Further, the panels provide little insulation compared to foams.

It would be desirable to have a foam which could be deployed underneath a membrane in a roofing system. It would further be desirable if such foam had a heat distortion temperature of 190° F. (88° C.) or more. It would further be desirable if such foam had excellent moisture resistance and mechanical strength similar to that of extruded, closed-cell polystyrene foams.

SUMMARY OF THE INVENTION

According to the present invention there is a roofing system for a structure. The process comprises a roof deck; a protective layer of a plurality of panels of an extruded alkenyl aromatic polymer foam situated above and adjacent the deck; and a substantially waterproof membrane situated above and adjacent to the foam. The foam comprises an alkenyl aromatic polymer material having greater than 50 percent by weight alkenyl aromatic monomeric units, and has from 30 to 80 percent open cell content.

Further according to the present invention there is a recovery roofing system for a structure. The roofing system comprises a pre-existing roofing system; a protective layer of a plurality of panels of an extruded alkenyl aromatic polymer foam situated above and adjacent the pre-existing roofing system; a substantially waterproof second membrane situated above and adjacent to the foam. The pre-existing roofing system comprises a roof deck and a first membrane situated above and adjacent the roof deck.

Further according to the present invention there is a process for constructing a roofing system for a structure. The process comprises providing a roof deck; applying above and adjacent to the upper surface of the roof deck a protective layer of a plurality of panels of an extruded alkenyl aromatic polymer foam; and applying a substantially waterproof membrane above and adjacent to the upper surface of the foam.

Further according to the present invention there is a process for constructing a recovery roofing system for a structure. The process comprises providing a pre-existing roofing system; applying above and adjacent to the upper surface of the pre-existing roofing system a protective layer of a plurality of panels of an extruded alkenyl aromatic polymer foam; and applying above (on top of) and adjacent to the upper surface of the foam a second membrane which is substantially waterproof. The pre-existing roofing system comprises a roof deck and a first membrane situated above and adjacent the roof deck.

In the above systems and processes, the protective layer is situated adjacent to and preferably contiguous to the membrane. Being contiguous is preferred because maximum physical protection is afforded the membrane.

When any component (roofing decks, membranes, protective layers, paving layers) of a roofing system or replacement roofing system is described as being adjacent to another component, they are situated in parallel and proximity to one another, but may or may not be in direct physical contact. When a component is described as being contiguous to another component, they are in direct physical contact.

BRIEF DESCRIPTION OF THE DRAWINGS

The features of the present invention will be better understood upon reviewing the drawings together with the remainder of the specification.

DETAILED DESCRIPTION OF THE INVENTION

The present invention affords new roofing systems and recovery roofing systems with enhanced longevity and performance. Longevity and performance are enhanced by improving the physical support and integrity of the roofing membrane. The improved physical support and integrity make the formation of membrane rupture less likely, resulting in a reduced incidence of water leakage through the roofing system.

The physical support and integrity of the membrane is enhanced by employing a protective layer of an extruded, open-cell alkenyl aromatic polymer foam underneath the membrane. The foam offers excellent heat and moisture resistance and mechanical strength.

The foam further enhances the heat insulation of the roofing system.

Figure 1:
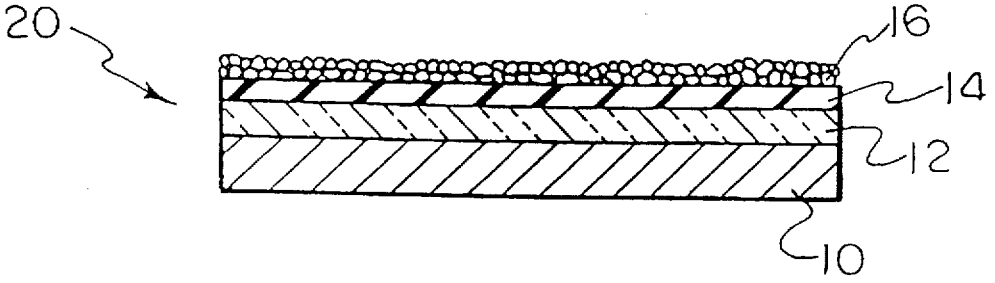
FIG. 1 is a cross-sectional view of a roofing system of the present invention.
Figure 3:
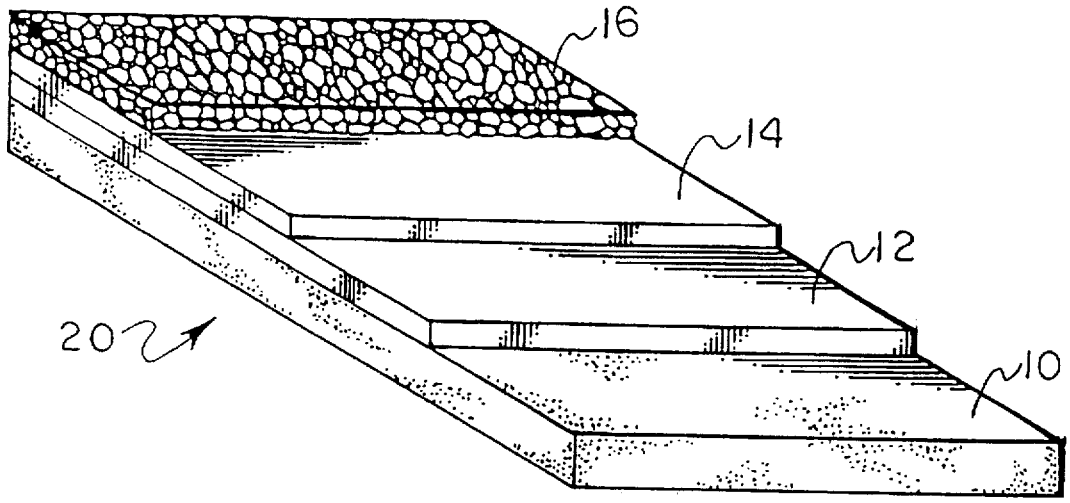
FIG. 3 is a cut away view of the roofing system illustrated in FIG. 1.

FIGS. 1 and 3 illustrate a new roofing system 20 of the present invention.

Roofing system 20 comprises in sequence a roof deck 10, a protective (foam) layer 12, a membrane 14, and a paving layer 16 stacked one on top of the other. Protective layer 12 comprises the extruded, open-cell alkenyl aromatic foam described herein. If insulation additional to that provided by protective layer 12 is desired, an insulating foam plastic material such as an extruded, closed-cell alkenyl aromatic polymer foam may be provided between protective layer 12 and roofing deck 10. It is understood that paving layers in the embodiments herein are optional.

Figure 2:
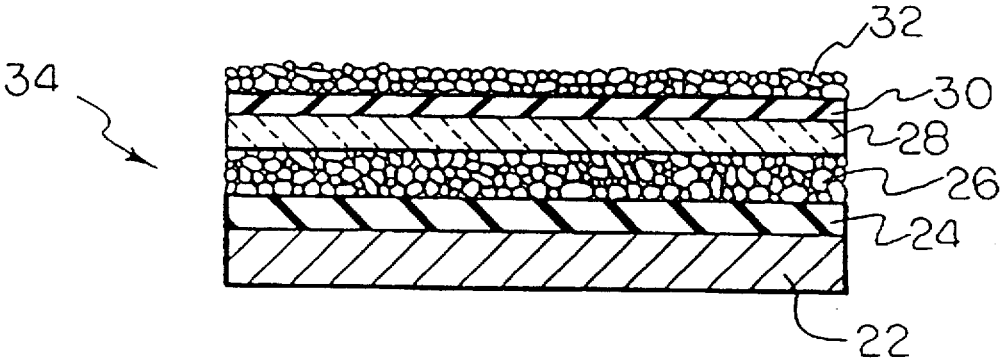
FIG. 2 is a cross-sectional view of a recovery roofing system of the present invention.
Figure 4:
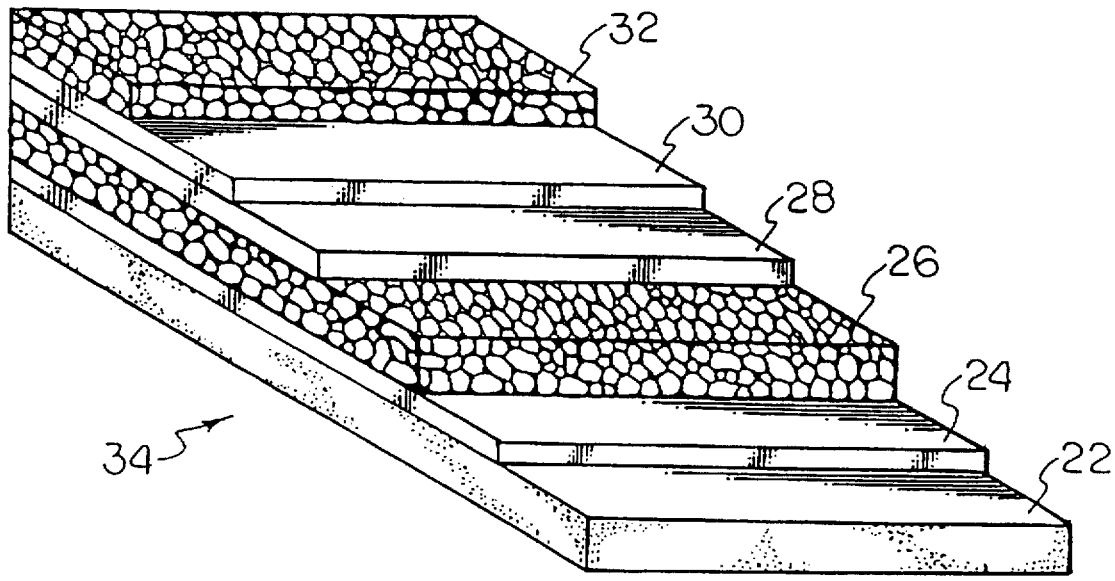
FIG. 4 is a cut away view of the recovery roofing system illustrated in FIG. 2.

FIGS. 2 and 4 illustrate an embodiment of a recovery roofing system 34 of the present invention. In employing a recovery roofing system, the cost of removing the pre-existing system is avoided by placing a new roofing system directly on top of the pre-existing roofing system. The pre-existing roofing system comprises a roof deck 22, a first membrane 24, and a first paving layer 26. The new roofing system comprises protective layer 28, second membrane 30, and second paving layer 32. If insulation additional to that provided by protective layer 28 is desired, another layer of an insulating foam plastic material such as an extruded, closed-cell alkenyl aromatic polymer foam may be provided between the first paving layer 26 and protective layer 28.

The extruded, alkenyl aromatic polymer foam provides enhanced performance in roofing systems over other materials employed in protective layers for roofing membranes in the prior art.

The extruded, open-cell foam offers moisture resistance and mechanical strength similar to that of a corresponding extruded, closed-cell alkenyl aromatic polymer foam, but also affords a higher heat distortion temperature. The open-cell foam has a heat distortion temperature up to 210° F. (99° C.), while the closed-cell foam has one of up to 175° F. (79° C.). Though not bound by any particular theory, the higher heat distortion temperature is believed due to the open-cell structure, which allows cell gas pressure to be relieved more readily than a closed-cell structure.

The extruded, open-cell foam affords a better heat distortion temperature than a corresponding expanded bead polystyrene foam, and has better mechanical strength and exhibits much lower water transmission. The extruded, open-cell foam has a unitary, cellular structure rather than a coalesced bead structure like the bead foam.

The extruded, open-cell foam exhibits much better moisture resistance than a closed-cell polyisocyanate foam or polyurethane foam, and, thus, is much less subject to physical deterioration. The open-cell foam affords a lower range of heat distortion temperatures than the polyisocyanate or polyurethane foam, but the afforded range is entirely sufficient for temperatures commonly encountered in roofing applications. Further, with respect to the polyurethane foam, the open-cell foam is more rigid, which makes it more effective in providing mechanical support. Further, the open-cell foam has friability characteristics (less friability) superior to those of polyisocyanurate and polyurethane foams.

The extruded, open-cell foam exhibits much better moisture resistance than a wood or wood composite panel. The open-cell foam affords heat distortion temperatures less than that of the wood or wood composite panel, but affords a range which is entirely sufficient for temperatures commonly encountered in roofing applications. Further, the open-cell foam provides much better insulation per unit thickness than the wood or wood composite panel.

The open-cell foam has a heat distortion temperature of from 175° F. to 210° F. (79° C. to 99° C.) and more preferably from 190° F. to 205° F. (88° C. to 96° C.) according to ASTM D-2126-87. The high heat distortion temperature of the foam enables it to be employed in high service temperature environments (175° F. to 210° F.) (79° C. to 99° C.) such as underneath dark roofing membranes in direct sunlight. The present foam has an excellent heat distortion temperature due to its open-cell structure.

The open-cell foam has an open cell content of 30 percent or more, preferably of 30 to 80 percent, and most preferably 40 to 60 percent according to ASTM D-2856-87.

The open-cell foam has a density of 1.5 pcf to 6.0 pcf (24 $kg/m^3$ to 96 $kg/m^3$) and preferably a density of 2.0 pcf to 3.5 pcf (32 $kg/m^3$ to 48 $kg/m^3$) according to ASTM D-1622-88.

The open-cell foam has an average cell size of from 0.08 millimeters (mm) to 1.2 mm and preferably from 0.10 mm to 0.9 mm according to ASTM D-3576-77.

The open-cell foam is particularly suited to be formed into a plank, desirably one having a minor dimension in cross-section (thickness) of greater than 0.25 inches (6.4 millimeters) or more and preferably 0.375 inches (9.5 millimeters) or more. Further, preferably, the foam has a cross-sectional area of 30 square centimeters (cm) or more.

The open-cell foam is substantially non-crosslinked. Substantially non-crosslinked means the foam is substantially free of crosslinking, but is inclusive of the slight degree of crosslinking which may occur naturally without the use of crosslinking agents or radiation. A substantially non-crosslinked foam has less than 5 percent gel per ASTM D-2765-84, method A.

The open-cell foam comprises an alkenyl aromatic polymer material. Suitable alkenyl aromatic polymer materials include alkenyl aromatic homopolymers and copolymers of alkenyl aromatic compounds and copolymerizable ethylenically unsaturated comonomers. The alkenyl aromatic polymer material may further include minor proportions of non-alkenyl aromatic polymers. The alkenyl aromatic polymer material may be comprised solely of one or more alkenyl aromatic homopolymers, one or more alkenyl aromatic copolymers, a blend of one or more of each of alkenyl aromatic homopolymers and copolymers, or blends of any of the foregoing with a non-alkenyl aromatic polymer. Regardless of composition, the alkenyl aromatic polymer material comprises greater than 50 and preferably greater than 70 weight percent alkenyl aromatic monomeric units. Most preferably, the alkenyl aromatic polymer material is comprised entirely of alkenyl aromatic monomeric units.

Suitable alkenyl aromatic polymers include those derived from alkenyl aromatic compounds such as styrene, alphamethylstyrene, ethylstyrene, vinyl benzene, vinyl toluene, chlorostyrene, and bromostyrene. A preferred alkenyl aromatic polymer is polystyrene. Minor amounts of monoethylenically unsaturated compounds such as $C_{2-6}$ alkyl acids and esters, ionomeric derivatives, and $C_{4-6}$ dienes may be copolymerized with alkenyl aromatic compounds. Examples of copolymerizable compounds include acrylic acid, methacrylic acid, ethacrylic acid, maleic acid, itaconic acid, acrylonitrile, maleic anhydride, methyl acrylate, ethyl acrylate, isobutyl acrylate, n-butyl acrylate, methyl methacrylate, and vinyl acetate. The foams are preferably substantially free of rubbery or rubber-like substances such as those with $C_{4-6}$ diene monomeric content. Preferred foams comprise substantially (that is, greater than 95 percent) and most preferably entirely of polystyrene.

The open-cell foam is generally prepared by heating an alkenyl aromatic polymer material to form a plasticized or melt polymer material, incorporating therein a blowing agent to form a foamable gel, and extruding the gel through a die to form the foam product. Prior to mixing with the blowing agent, the polymer material is heated to a temperature at or above its glass transition temperature or melting point. The blowing agent may be incorporated or mixed into the melt polymer material by any means known in the art such as with an extruder, mixer, or blender. The blowing agent is mixed with the melt polymer material at an elevated pressure sufficient to prevent substantial expansion of the melt polymer material and to generally disperse the blowing agent homogeneously therein. A nucleating is blended in the polymer melt or dry blended with the polymer material prior to plasticizing or melting. The foamable gel is typically cooled to a lower temperature to optimize or attain desired physical characteristics of the foam. The gel may be cooled in the extruder or other mixing device or in separate coolers. The gel is then extruded or conveyed through a die of desired shape to a zone of reduced or lower pressure to form the foam. The zone of lower pressure is at a pressure lower than that in which the foamable gel is maintained prior to extrusion through the die. The lower pressure may be superatmospheric or subatmospheric (evacuated or vacuum), but is preferably at an atmospheric level.

More specifically, the foam may be prepared by: a) heating an alkenyl aromatic polymer material comprising more than 50 percent by weight alkenyl aromatic monomeric units to form a melt polymer material; b) incorporating into the melt polymer material an amount of a nucleating agent sufficient to result in a foam having from 30 percent to 80 percent open cell content; c) incorporating into the melt polymer material at an elevated pressure a blowing agent to form a foamable gel; d) cooling the foamable gel to a suitable foaming temperature; and e) extruding the foamable gel through a die into a region of lower pressure to form the foam. The foaming temperature ranges from 118° C. to 145° C. wherein the foaming temperature is from 3° C. to 15° C. higher than the highest foaming temperature for a corresponding closed-cell foam. The foaming temperature must be 133° C. or more. The foaming temperature further must be 33° C. or more higher than the glass transition temperature (according to ASTM D-3418) of the alkenyl aromatic polymer material.

Any blowing agent useful in making extruded alkenyl aromatic polymer foams maybe employed. Useful blowing agents include 1-chloro-1,1-difluoroethane (HCFC-142b), chlorodifluoromethane (HCFC-22), 1,1-difluoroethane (HFC-152a), 1,1,1-trifluoroethane (HFC-143a), 1,1,1,2-tetrafluoroethane (HFC-134a), water ethanol, carbon dioxide, ethyl chloride, and mixtures of the foregoing. A preferred blowing agent comprises a mixture of carbon dioxide and ethyl chloride.

The amount of nucleating agent employed will vary according to desired cell size, foaming temperature, and composition of the nucleating agent. Open-cell content increases with increasing nucleating agent content. Useful nucleating agents include calcium carbonate, calcium stearate, talc, clay, titanium dioxide, silica, barium stearate, diatomaceous earth, and mixtures of citric acid and sodium bicarbonate. Preferred nucleating agents are talc and calcium stearate. The amount of nucleating agent employed may range from 0.01 to 5 parts by weight per hundred parts by weight of a polymer resin. The preferred range is from 0.4 to 3.0 parts by weight.

Extensive teachings to the preparation of the open-cell foam are seen in co-pending application U.S. Ser. No. 08/264,669, filed Jun. 23, 1994.

The open-cell foam optionally further comprises carbon black. Carbon black enhances the thermal resistance or insulation of the foam. The carbon black may comprise between 1.0 and 25 weight percent and preferably between 4.0 and 10.0 weight percent based upon the weight of the alkenyl aromatic polymer material in the foam. The carbon black may be of any type known in the art such as furnace black, thermal black, acetylene black, and channel black. A preferred carbon black is thermal black. A preferred thermal black has an average particle size of 150 nanometers or more.

Small amounts of an ethylene polymer such as linear low density polyethylene or high density polyethylene may be incorporated into the foamable gel to enhance open-cell content upon extrusion and foaming.

Various additives may be incorporated in the foam such as inorganic fillers, pigments, anti oxidants, acid scavengers, ultraviolet absorbers, flame retardants, processing aids, and extrusion aids.

EXAMPLES

The following are examples of the present invention, and are not to be construed as limiting. Unless otherwise indicated, all percentages, parts, or proportions are by weight.

Open-cell alkenyl aromatic polymer foam structures of the present invention are made according to the process of the present invention.

Example 1

An open-cell extruded polystyrene foam was tested for dimensional stability at 205° F. for 3 hours according to test method ASTM D2126-87. The heat distortion characteristics of the foam were excellent. The length difference was 0.2 percent of initial, the width difference was −0.1 percent of initial, and the thickness difference was 0.2 percent of initial.

The foam had 50 to 70 percent open cell content, 2.19 pcf (35 kg/m$^3$), and a 0.30 millimeter cell size.

Example 2

An open-cell extruded polystyrene foam was tested for bowing when one side was exposed. A Thermotron FM-46 oven with minimum inner dimensions of 42 inches (107 cm) by 38 inches (97 cm) and a capability of maintaining a constant temperature 205° F.±5° F. was used. The foam was attached to a wooden platform with four metal corner fasteners in the oven. The platform was left in place for the desired period of time. The foam was exposed to a temperature of 200° F. for 30 minutes while the other side supported by a wooden platform remained at ambient conditions.

The bowing characteristics of the foam were excellent considering the extreme temperature conditions to which the foam was exposed. The maximum bow was an average of 17 millimeters. Bowing was determined by measuring the distance from the bottom of the foam to the platform. If the foams were placed on a roof under a membrane, bowing would be less because of the restraining influence of the membrane. Under normal hot-roof conditions under a membrane, such as exposure temperatures of 190° F. or less, preferred foams would have a maximum bow of not more than 6 millimeters.

The sample had 50 to 70 percent open cell content, 2.19 pcf (35 kg/m$^3$), and a 0.30 millimeter cell size.

While embodiments of the foam and the process of the present invention have been shown with regard to specific details, it will be appreciated that depending upon the manufacturing process and the manufacturer's desires, the present invention may be modified by various changes while still being fairly within the scope of the novel teachings and principles herein set forth.

We claim:

1. A roofing system for a structure, comprising:

a) a roof deck;

b) a protective layer of a plurality of panels of an extruded alkenyl aromatic polymer foam situated above and adjacent the deck, the foam comprising an alkenyl aromatic polymer material having greater than 50 percent by weight alkenyl aromatic monomeric units, the foam having 30 percent or more open cell content; and c) a substantially waterproof membrane situated above and adjacent to the foam panels.

2. The roofing system of claim 1, wherein the system further comprises a paving layer above and adjacent the membrane.

3. The roofing system of claim 1, wherein the protective layer is contiguous to the membrane.

4. The roofing system of claim 1, wherein the foam further comprises a nucleating agent, the foam having a minor dimension in cross-section of 0.25 inches or more, the foam having a density of 1.5 pcf to 6.0 pcf, the foam having an average cell size of 0.08 mm to 1.2 mm, the foam having a heat distortion temperature of 175° F. to 210° F., the alkenyl aromatic polymer material comprising greater than 70 weight percent alkenyl aromatic monomeric units, the alkenyl aromatic polymer material comprising polystyrene.

5. The roofing system of claim 4, wherein the foam has an open cell content of from 40 to 60 percent.

6. The roofing system of claim 3, wherein the foam further comprises a nucleating agent, the foam having a minor dimension in cross-section of 0.25 inches or more, the foam having a density of 1.5 pcf to 6.0 pcf, the foam having an average cell size of 0.08 mm to 1.2 mm, the foam having a heat distortion temperature of 175° F. to 210° F., the alkenyl aromatic polymer material comprising greater than 70 weight percent alkenyl aromatic monomeric units, the alkenyl aromatic polymer material comprising polystyrene.

7. The roofing system of claim 1, wherein the foam further comprises a nucleating agent, the foam having a minor dimension in cross-section of 0.25 inches or more, the foam having a density of 2.0 pcf to 3.5 pcf, the foam having an average cell size of 0.1 mm to 0.9 mm, the foam having a heat distortion temperature of 190° F. to 205° F., the alkenyl aromatic polymer material comprising greater than 95 percent polystyrene.

8. The roofing system of claim 3, wherein the foam further comprises a nucleating agent, the foam having a minor dimension in cross-section of 0.25 inches or more, the foam having a density of 2.0 pcf to 3.5 pcf, the foam having an average cell size of 0.1 mm to 0.9 mm, the foam having a heat distortion temperature of 190° F. to 205° F., the alkenyl aromatic polymer material comprising greater than 95 percent polystyrene.

9. The roofing system of claim 1, wherein the panels do not bow more than 6 millimeters upon exposure to elevated temperatures for an extended period of time.

10. A recovery roofing system for a structure, comprising:

a) a pre-existing roofing system, comprising:

i) a roof deck; and ii) a first membrane situated above and adjacent the roof deck;

b) a protective layer of a plurality of panels of an extruded alkenyl aromatic polymer foam situated above and adjacent the first membrane, the foam comprising an alkenyl aromatic polymer material having greater than 50 percent by weight alkenyl aromatic monomeric units, the foam having 30 percent or more open cell content; and c) a second membrane situated above and adjacent to the foam panels, the second membrane being substantially waterproof.

11. The roofing system of claim 10, wherein the protective layer is contiguous to the second membrane.

12. The roofing system of claim 10, wherein the foam further comprises a nucleating agent, the foam having a minor dimension in cross-section of greater than 0.25 inches, the foam having a density of 1.5 pcf to 6.0 pcf, the foam having an average cell size of 0.08 mm to 1.2 mm, the foam having a heat distortion temperature of 175° F. to 210° F., the alkenyl aromatic polymer material comprising greater than 70 weight percent alkenyl aromatic monomeric units, the alkenyl aromatic polymer material comprising polystyrene.

13. The roofing system of claim 12, wherein the foam has an open cell content of from 40 to 60 percent.

14. The roofing system of claim 11, wherein the foam further comprises a nucleating agent, the foam having a minor dimension in cross-section of greater than 0.25 inches, the foam having a density of 1.5 pcf to 6.0 pcf, the foam having an average cell size of 0.08 mm to 1.2 mm, the foam having a heat distortion temperature of 175° F. to 210° F., the alkenyl aromatic polymer material comprising greater than 70 weight percent alkenyl aromatic monomeric units, the alkenyl aromatic polymer material comprising polystyrene.

15. The roofing system of claim 10, wherein the foam further comprises a nucleating agent, the foam having a minor dimension in cross-section of 0.375 inches or more, the foam having a density of 2.0 pcf to 3.5 pcf, the foam having an average cell size of 0.1 mm to 0.9 mm, the foam having a heat distortion temperature of 190° F. to 205° F., the alkenyl aromatic polymer material comprising greater than 95 percent polystyrene.

16. The roofing system of claim 11, wherein the foam further comprises a nucleating agent, the foam having a minor dimension in cross-section of 0.375 inches or more, the foam having a density of 2.0 pcf to 3.5 pcf, the foam having an average cell size of 0.1 mm to 0.9 mm, the foam having a heat distortion temperature of 190° F. to 205° F., the alkenyl aromatic polymer material comprising greater than 95 percent polystyrene.

17. The roofing system of claim 10, wherein the panels do not bow more than 6 millimeters upon exposure to elevated temperatures for an extended period of time.

18. A process for constructing a roofing system for a structure, comprising:

a) providing a roof deck;

b) applying above and adjacent the roof deck a protective layer of a plurality of panels of an extruded alkenyl aromatic polymer foam wherein the foam comprises an alkenyl aromatic polymer material having greater than 50 percent by weight alkenyl aromatic monomeric units and further has 30 percent or more open cell content; and c) applying a substantially waterproof membrane above and adjacent to the foam panels.

19. The process of claim 18, wherein the membrane is applied contiguously to the protective layer.

20. The process of claim 18, wherein the panels do not bow more than 6 millimeters upon exposure to elevated temperatures for an extended period of time.

21. A process for constructing a replacement roofing system for a structure, comprising:

a) providing a pre-existing roofing system, comprising:

i) a roof deck; and ii) a first membrane situated above and adjacent the roof deck;

b) applying above and adjacent the pre-existing roofing system a protective layer of a plurality of panels of an extruded alkenyl aromatic polymer foam wherein the foam comprises an alkenyl aromatic polymer material having greater than 50 percent by weight alkenyl aromatic monomeric units and further has 30 percent or more open cell content; and c) applying above and adjacent to the foam panels a second membrane which is substantially waterproof.

22. The process of claim 21, wherein the second membrane is applied contiguously to the protective layer.

23. The process of claim 21, wherein the panels do not bow more than 6 millimeters upon exposure to elevated temperatures for an extended period of time.

* * * * *